US005649532A

United States Patent [19]

Griffiths

[11] Patent Number: 5,649,532

[45] Date of Patent: Jul. 22, 1997

[54] BREATHING EQUIPMENT FOR AIRCREW

[76] Inventor: Joseph Anthony Griffiths, Midtrees, Lythe, Lythe Hill Estate, Petworth Road, Hazlemere, Surrey GU27 3AX, Great Britain

[21] Appl. No.: 331,611

[22] PCT Filed: May 5, 1993

[86] PCT No.: PCT/GB93/00927

§ 371 Date: Jan. 18, 1995

§ 102(e) Date: Jan. 18, 1995

[87] PCT Pub. No.: WO93/21994

PCT Pub. Date: Nov. 11, 1993

[30] Foreign Application Priority Data

May 5, 1992 [GB] United Kingdom ..... 9209627

[51] Int. Cl.[6] ..... A62B 18/08

[52] U.S. Cl. ..... 128/206.24; 128/201.23; 128/202.11; 128/205.25; 128/207.11; 2/2.14; 600/19

[58] Field of Search ..... 600/19, 20; 128/201.22, 128/201.23, 201.24, 202.11, 205.25, 206.21, 206.23, 206.24, 206.28, 207.11; 2/2.14, 2.11

[56] References Cited

U.S. PATENT DOCUMENTS

| | | | |
|---|---|---|---|
| 3,545,437 | 12/1970 | Quackenbush | 128/204.15 |
| 5,355,878 | 10/1994 | Griffiths et al. | 128/206.24 |

FOREIGN PATENT DOCUMENTS

| | | |
|---|---|---|
| 0105813 | 4/1984 | European Pat. Off. . |
| 0325959 | 8/1989 | European Pat. Off. . |
| 979357 | 1/1965 | United Kingdom . |
| 2045090 | 10/1980 | United Kingdom . |
| 2074457 | 11/1981 | United Kingdom . |
| WO92/00120 | 1/1992 | WIPO . |

*Primary Examiner*—Jennifer Bahr
*Assistant Examiner*—Eric P. Raciti
*Attorney, Agent, or Firm*—Dilworth & Barrese

[57] ABSTRACT

A facemask incorporating breathing equipment for use with a flying helmet (2) comprises a rigid outer shell (4) in which a flexible face-piece (3) is housed whose periphery makes an airtight seal with the pilot's face (1). The face-piece (3) includes an inhalatory valve (11) and an expiratory vane (9) and the rigid shell (4) is attached to the helmet (2) by a harness (5) which keeps the shell (4) at a fixed distance from the helmet (2). Inflatable means (15, 20) are provided between the shell (4) which are inflated to press the periphery (14) of the face-piece towards the pilot's face when the pressure of breathable gas supplied to the interior of the mask and to said inflatable means increases above that required for normal breathing. Alternatively, the face-piece (3) can include extendable means in the form of a re-entrant section (30, 34, 35) or bellows section (36) which extends in a direction towards the pilot's face when the pressure of the breathable gas supplied to the interior of the face-piece (3) increases above that required for normal breathing.

7 Claims, 4 Drawing Sheets

FIG. 3D.
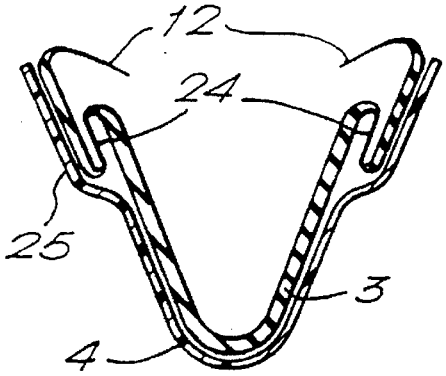
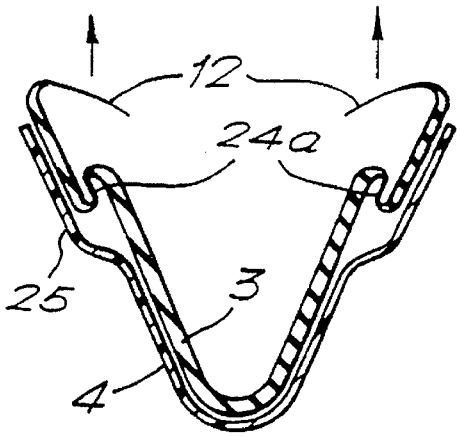
FIG. 3E.
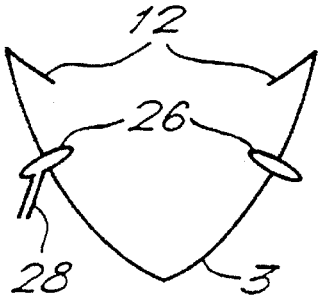
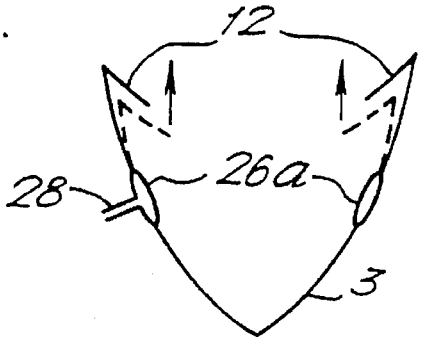
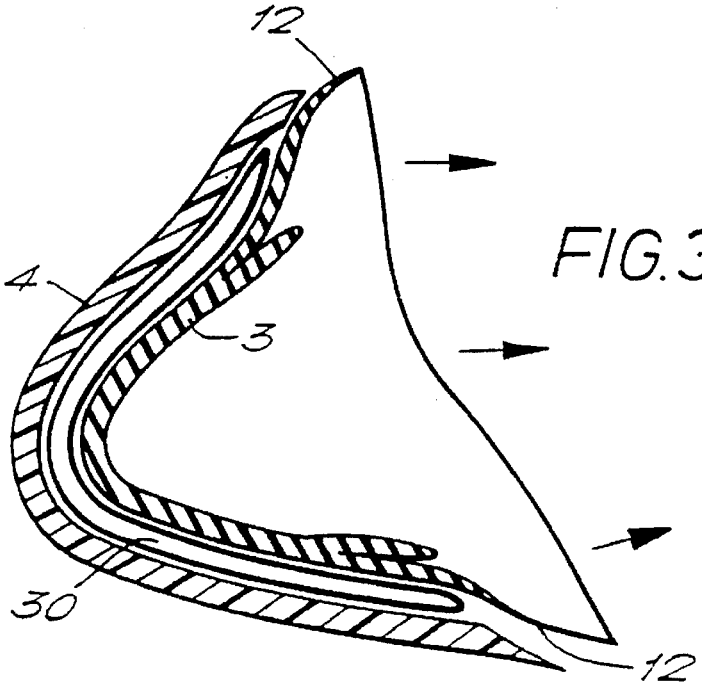
FIG. 3F.

BREATHING EQUIPMENT FOR AIRCREW

BACKGROUND OF THE INVENTION

1. Field of the Invention

This invention relates to breathing equipment for aircrew and more particularly to breathing equipment which can be used in conjunction with electronic avionic systems.

2. BACKGROUND OF RELATED ART

Avionic systems used by pilots generally require part of the system to be helmet mounted but the helmet has to be maintained in a fixed position relative to the wearer's head and eyes if the avionics are to work properly.

Another problem with modem breathing equipment used by aircrew is that it has to incorporate means to increase the seal that the facemask with the wearer's face during pressure breathing otherwise the facemask leaks when the breathable gas at the required increased pressure is fed to the interior of the mask. In one prior art arrangement, an inflatable bag is provided at the rear of the pilot's helmet which expands when pressure breathing is required with the result that the helmet moves rearwardly and the facemask connected to it is pulled towards the wearer's face to maintain the required seal therewith. The problem with this arrangement is that the helmet moves relative to the pilot's head so avionics systems cannot be mounted to it as they require a stable mounting platform. Furthermore, as the viewing screen onto which the avionics image is projected must be kept at a fixed distance from the wearer's eyes, it cannot be mounted on a facemask which moves relative to the wearer's face because its position relative to the pilot's eyes will change constantly in response to the pressure of the breathable gas supplied to the facemask.

In our earlier filed patent application referred to above, which has been published under No.PCT/GB91/01034, we overcame the problem of keeping the helmet in a fixed position by mounting the movable facemask within a rigid outer shell attached to the helmet at a fixed distance therefrom and fitting an inflatable bladder between the rigid shell and the facemask which could be inflated to press the periphery of the facemask towards the pilot's face when the pressure of the breathable gas supplied to the interior of the mask and the inflatable bladder increased above that for normal breathing. In another embodiment, the facemask included a re-entrant or bellows section which reconfigured and extended in a direction towards the pilot's face when the pressure of the breathable gas supplied to the interior of the facemask increased above that required for normal breathing.

The significant feature of our earlier breathing system was that the facemask was dynamically movable relative to the pilot's face due to the reaction between the rigid outer shell and the inflatable bladder or between the rigid outer shell and the re-entrant or bellows section incorporated in the facemask. Thus, it was the facemask not the helmet which moved when pressure breathing was required so avionics could be mounted on the helmet.

The problems discussed above are further compounded if the facemask has to be incorporated into a hood to protect the wearer against nuclear, biological or chemical (NBC) agents and also be capable of use with helmet mounted avionics. This is because the distance between the clear visor area provided in the rigid front portion of the hood to enable the wearer to see has to be kept at a fixed distance in relation to the wearer's eyes. This is difficult to achieve in conventional breathing equipment which does not have a dynamically movable facemask as this distance can vary depending on the shape of the wearer's chin. This is a particular problem if night vision glasses (NVG) are to be used because the distance between the wearer's eyes and the NVG is critical and must not vary. Furthermore, when the wearer is subjected to G forces in an aeroplane of up to 9G for instance, the helmet becomes very unstable, particularly if a rear inflatable bladder is used.

The Applicants have now realised that their earlier breathing system can be modified to have a clear viewing screen or visor fitted thereto or incorporated therein onto which images can be projected by avionics systems mounted either on the pilot's helmet or elsewhere in the cockpit as the rigid shell provides a stable non-movable platform to support the screen or visor. It can also be readily adapted for use with an NBC hood including a respirator.

SUMMARY OF THE INVENTION

According to the present invention therefore, there is provided a facemask incorporating breathing equipment comprising a rigid outer shell in which a flexible face-piece is received whose periphery is adapted to make a seal with the pilot's face, the face-piece incorporating an inspiratory and expiratory valve and the outer shell having means for attaching it at a fixed distance from the wearer's face, the face-piece further including extendable means automatically operable to press the periphery of the face-piece towards the pilot's face to improve the seal therewith when gas at a pressure above that required for normal breathing is supplied to the facemask and the extendable means reconfigure as a result thereof, the improvement comprising providing transparent viewing means mounted on the rigid outer shell which, in use, are located in the wearer's line of sight.

The transparent viewing means can take any convenient form. For instance, the outer shell can comprise the rigid front piece of an NBC hood which incorporates a viewing window therein as an integral part thereof. Alternatively, the viewing means can comprise a transparent screen mounted on an arm extending from the rigid shell into the pilot's line of sight. In another embodiment, the rigid outer shell can comprise the front part of a full-face helmet similar to a motor racing or motorcycle helmet, the visor or window assembly in said helmet comprising the transparent viewing means.

The extendable means can be a bladder located between the rigid outer shell and facemask or can comprise bellows-like configurations provided at the periphery of the facemask which extend when air is supplied to the interior thereof. The extendable means can also comprise a combination of beth the inflatable bladder and the bellows or similar reconfigurable means.

Whilst it is expected that the facemask would normally be used in conjunction with a pilot's flying helmet, it could nevertheless be designed to work without a helmet by having a non-extendable strap attached to each side of the rigid outer shell to extend round the wearer's head to hold the facemask in place.

BRIEF DESCRIPTION OF THE DRAWINGS

Preferred embodiments of the invention will now be described, by way of example only, with reference to the accompanying drawings, in which: FIGS. 3A–3E illustrate various different types of reconfigurable extendable means which can be incorporated in the movable face-piece;

FIG. 3F illustrates in cross section a facemask of the invention having an inflatable bladder between the rigid shell and the front of the movable face-piece;

DETAILED DESCRIPTION OF THE PREFERRED EMBODIMENTS

Figure 1:
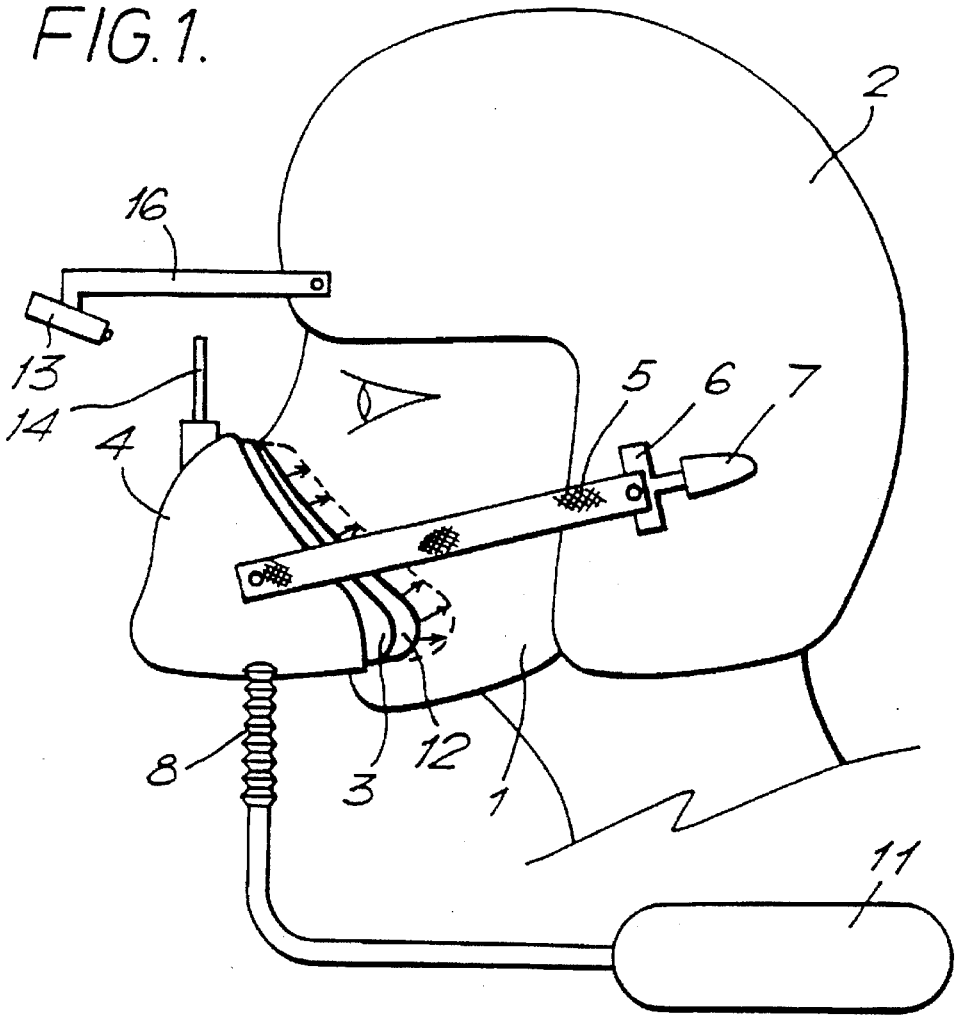
FIG. 1 shows a facemask of the present invention used in conjunction with a helmet mounted avionics system.

Referring to the drawings, FIG. 1 shows a pilot (1) wearing a rigid protective helmet (2). A flexible breathing face-piece (3), usually made of natural or synthetic rubber, surrounds the pilot's nose and mouth and is mounted in a rigid plastic shell (4) attached to the helmet (2) by means of harness arrangement (5) having fitting (6) at one end to releasably attach it to fitting part (7) mounted on the helmet. The badness (5) includes adjustable means (not shown) so that its length can be readily altered to ensure that the face-piece (3) rests comfortably on the pilot's face with its edge lip (12) making a proper seal with the area of the pilot's face surrounding his nose and mouth. An avionics system (13) such as an armament sight is mounted on arm (16) attached to the helmet (2) to protrude forwardly therefrom into the line of vision as illustrated. A transparent viewing screen (14) is mounted on the shell (4) in front of the pilot's eyes to display images projected from avionics (13).

Breathable gas such as oxygen is supplied to the interior of the face-piece (3) from a supply (11) via an oxygen regulator (not shown) connected thereto by means of a hose (8). An expiratory valve (not shown) is also provided in the face-piece (3).

Figure 2:
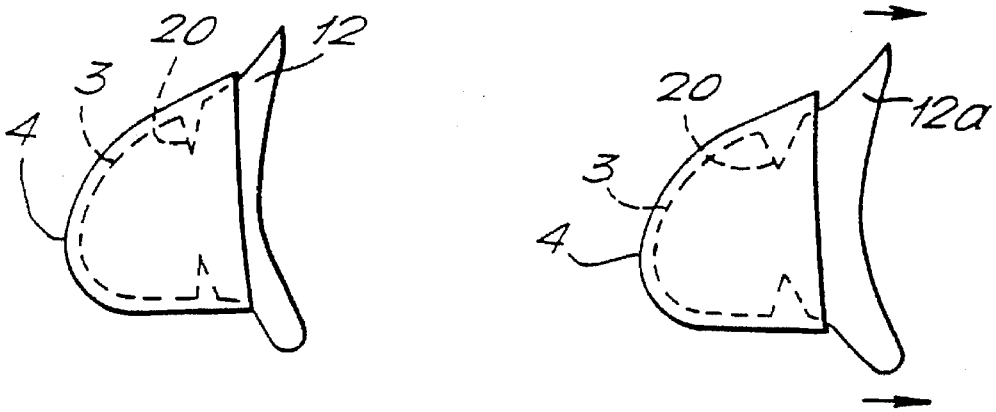
FIG. 2 is a diagrammatic illustration showing how the face-piece of FIG. 1 is caused to move during pressure breathing.

As can be seen more clearly in FIG. 2, the wall of the face-piece (3) includes extendable means (20) which are housed within the rigid shell (4). The purpose of the extendable means (20) is to enable the edge seal (12) to move in a direction generally parallel to the wall of the rigid shell (4) when the pressure of the breathable gas supplied to the interior of the face-piece (3) is increased as a result of the regulator (not shown) being activated when the aircraft makes a turn. When the pressure supplied to the interior of the face-piece (3) increases, its wall expands to cope with the increased pressure. As the wall cannot move radially outwardly because it is contained within the rigid shell (4), it can only move in a direction generally towards the pilot's face in the direction of the arrows and thereby improves its seal therewith.

The operation of the arrangement in FIGS. 1 and 2 follows:

In normal flight where no G-forces are exerted on the aircraft, breathable gas is supplied from the pressurised supply (11) via inlet hose (8) to the interior of the face-piece (3) fitted over the pilot's nose and mouth. As soon as the pilot makes a turn, this will generate G-forces which cause the regulator (not shown) to increase the pressure of the gas supplied from the source (11) to the interior of face-piece (3) and it is inflated. As the rigid shell (4) cannot move relative to the helmet (2) because its position in relation thereto is controlled by the harness (5) which is of fixed length, inflation of the face-piece (3) extends the extendable means (20) and the edge seal (12) is pushed towards the helmet (2) as indicated by the arrows in FIG. 2. This movement effectively increases the pressure f the edge seal (12) of the face-piece (3) on the pilot's face. Reductions in the gas supply pressure cause the face-piece (3) to deflate accordingly and thus to reduce the pressure of the edge seal (12) on the pilot's face.

It will be appreciated that during flight, the aeroplane will be making many turns and the G-forces generated will therefore vary considerably. The regulator (not shown) which controls the gas supply from the source (11) in combination with the inflation and deflation of the face-piece (3) therefore ensures that the edge seal (12) is kept in contact with the pilot's face at the required pressure at all times.

Since it is the face-piece (3) which is moving relative to the pilot's face to increase or decrease its seal therewith, the helmet (2) remains stationary at all times so the avionics sight (13) can be attached to it and will work perfectly satisfactory regardless of the G-forces to which the pilot or the aircraft is being subjected.

FIGS. 3A–3D illustrate several different types of flexible face-piece (3) which incorporate alternative forms of extendable means. In each of these embodiments the breathable gas is supplied directly to the interior of the face-piece (3) at a constantly changing pressure as a result of which the extendable means reconfigure and extend/expand or contract.

Figure 3A:
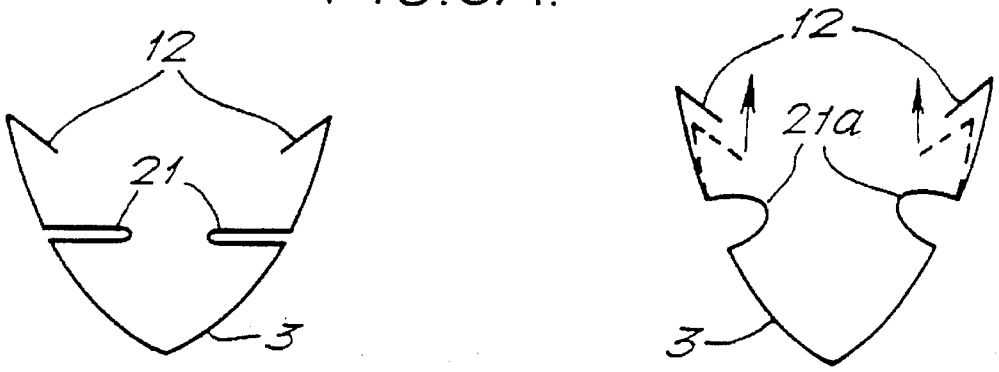

In the arrangement shown in FIG. 3A, the wall of the face-piece (3) includes a re-entrant section (21) which opens up or extends on pressurisation of the interior of the face-piece (3) to reconfigure into the profile (21*a*) whereby the edge region (12) shown in dotted line moves in the direction of the arrows into the position shown in full line.

Figure 3B:
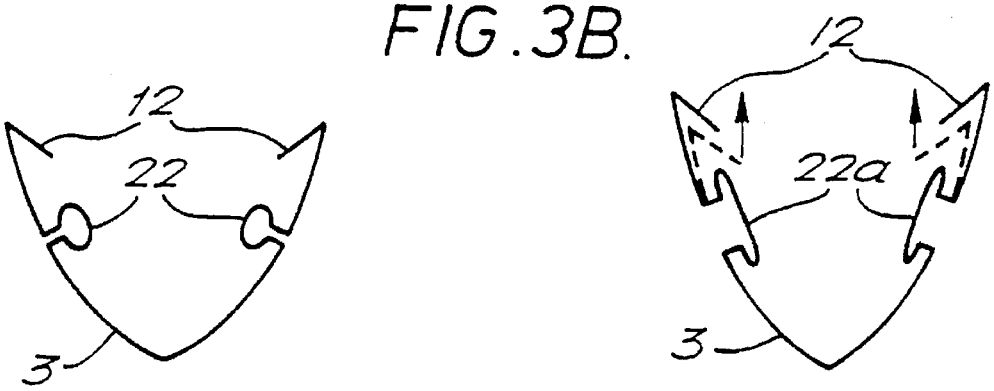

The face-piece (3) shown in FIG. 3B is similar to that shown in FIG. 3A except that the re-entrant sections (22) include a generally circular portion in cross-section and reconfigure on inflation of the interior of the face-piece (3) into the profile (22*a*) whereby the edge region (12) shown in dotted line moves in the direction of the arrows into the position shown in full line.

Figure 3C:
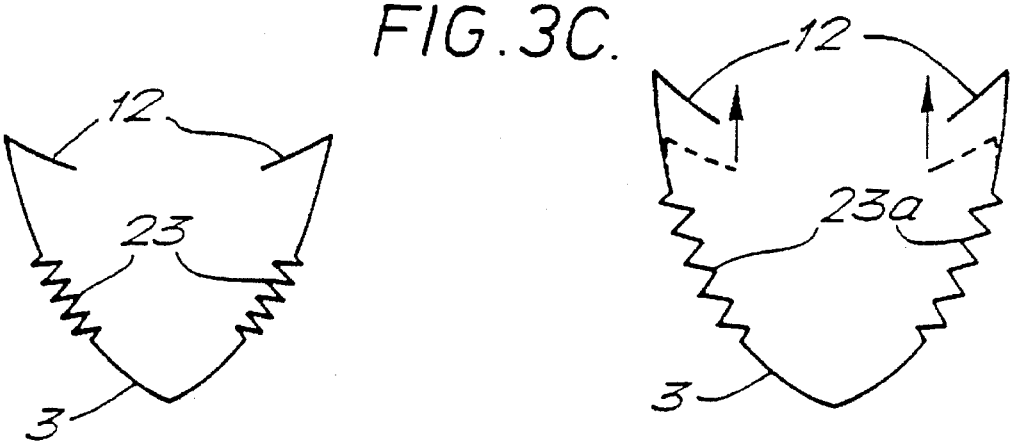

FIG. 3C shows yet another configuration of face-piece (3) incorporating a bellows section (23) which extends into configuration (23*a*) and causes the edge region (12) to move towards the pilot's face.

In the arrangement shown in FIG. 3D, the facemask (3) is housed within the rigid shell (4) as has already been described. The face-piece (3) is manufactured with a convoluted rolling section (24) situated behind and adjacent the edge seal (12) and accommodated in an enlarged section (25) of the rigid shell (4). As can be seen from the drawings, the thickness of the wall of the face-piece (3) in the region of the convoluted rolling section (24) is thinner than the remainder of the face-piece (3) thereby allowing it to be rolled back on itself into the S-shaped configuration illustrated. In its normal state, the face-piece (3) is contained within the shell enlargement (25). However, when the pressure of the gas supply to the interior of the facemask (3) is increased, the convoluted rolling section (24) tends to unroll and the edge seal (33) is moved in the direction of the arrows thereby increasing the force applied by the edge seal (12) to the pilot's face thus preventing leakage.

In some circumstances it may be advisable to provide an inflatable bladder (30) between the rigid outer shell (4) and the front region of the face-piece (3) as shown in FIG. 3F to assist in the dynamic movement of the face-piece (3) in response to changes in pressure of the breathable gas supply to the interior thereof. The bladder (30) is preferably inflated by means of a branch supply duct (not shown) from the main gas supply to the interior of the face-piece (3). It can however be inflated by a separate gas supply.

The facemask (3) shown in FIG. 3E differs from those shown in FIGS. 3A–3D in that it incorporates a chamber (26) which is supplied via an inlet (28) from a separate gas supply (not shown) to that supplied to the interior of the face-piece (3). The gas supply to the chamber (26) has to be at a pressure higher than that supplied to the interior of the face-piece (3) otherwise it will not be inflated and assume the illustrated configuration (26*a*) in which the edge seal (14) is moved in the direction of the arrows towards the pilot's face.

It will be seen from the foregoing description that the invention provides a simple dynamic system which adjusts the pressure of the face-piece (3) on the pilot's face automatically in response to the regulator controlled breathable gas supply pressure. As it is the face-piece (3) which moves rather than the helmet (2) or the shell (4), avionic systems can be mounted on the helmet.

Figure 4:
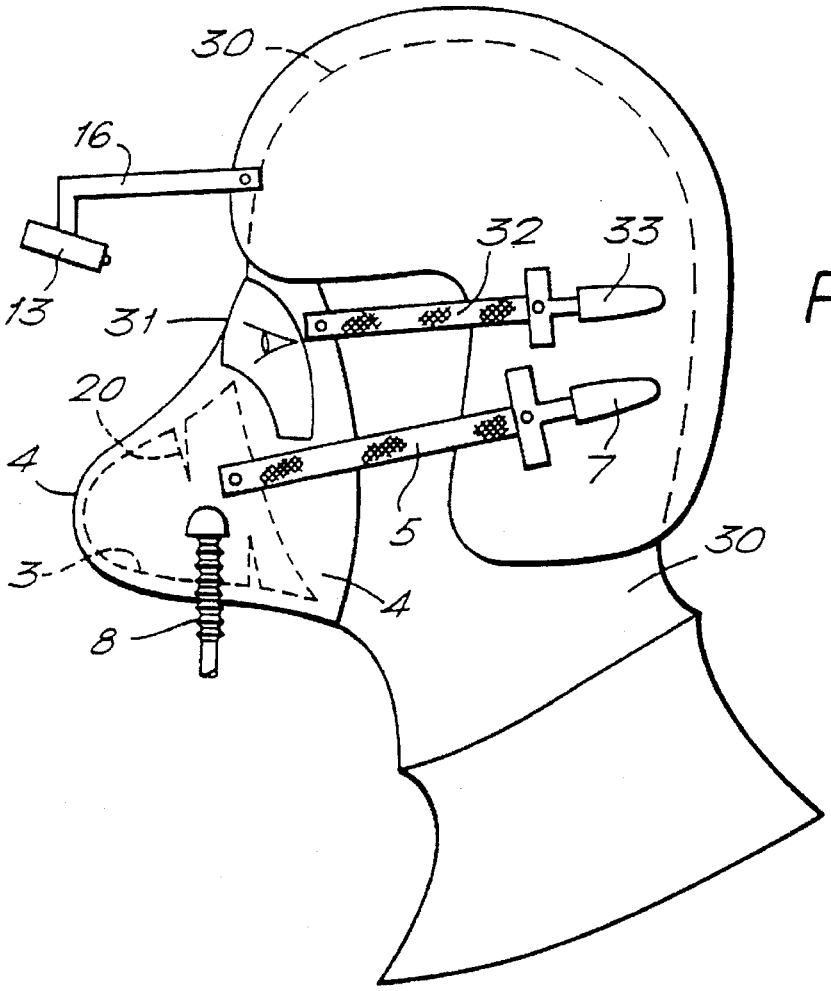
FIG. 4 illustrates a facemask of the invention incorporated into an NBC respirator with a protective hood.

Referring now to FIG. 4, this shows a facemask of the invention incorporated into an NBC respirator having a protective hood (30). In this arrangement, the whole of the front portion of the hood (30) is moulded from a rigid plastics material and includes within it a transparent viewing window (31). The hoed (30) is preferably made of rubber and attached to the edges of the front piece (4) to enclose the wearer's head and extend over the wearer's neck.

As with the FIG. 1 embodiment, the rigid front portion (4) is attached to the helmet (2) by means of the harness (5). In the embodiment illustrated in FIG. 4 however, an optional second harness (32) is connected to the rigid front portion (4) adjacent the wearer's temples and is releasably secured to the helmet (2) by means of a fitting (33). It will be seen therefore that as both harnesses (7,33) are made of an inextendable webbing material, the rigid front portion (4) of the hood (30) cannot move in a direction away from the helmet (2).

A dynamically movable face-piece (3) is mounted in the rigid front piece (4) which can be of any type such as those already described with reference to FIGS. 1–3. The face-piece (3) illustrated is the same as that shown in FIG. 2 and includes re-entrant section (20) but this is for illustrative purposes only. Breathable gas is fed to the interior of the face-piece (3) through inlet hose (8) connected to the gas source and regulator (not shown).

It will be appreciated that with the arrangement shown in FIG. 4, the window (31) can be kept at a fixed distance from the pilot's eyes at all times during flight as it is the face-piece (3) which moves relative to the wearer's face rather than the front piece (4) or the helmet (2) to cope with increases or decreases in the pressure of the breathable gas supplied to the interior of the face-piece. As a result, the viewing window (31) can be used as a screen onto which images can be projected from the avionics (13) mounted on the helmet (2) on arm (16). As harnesses (5,32) include adjustment means (not shown) the position of the window (31) relative to the pilot's eyes can be adjusted pre-flight to suit the pilot's particular viewing requirements. Once set however, no further adjustments need to be made in-flight. Similarly, the position of the avionic part (13) relative to the window (31) can be set pre-flight which is another critical distance which must not change during flight if the pilot is to be able to read the data projected onto the window (31).

Figure 5:
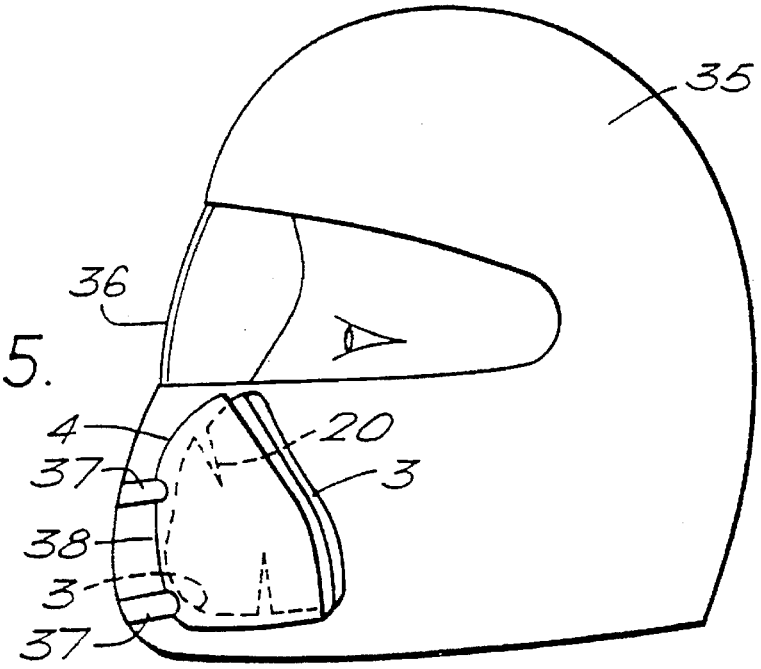
FIG. 5 illustrates a facemask of the invention incorporated into a full-face helmet.

FIG. 5 shows a facemask of the invention incorporated into a full-face helmet (35) having a visor (36) which can be either fixed or pivotable upwardly out of the wearer's line of vision.

A rigid plastics shell (4) is attached to the interior of the front portion (38) of the helmet (35) by mounting arms (37) although it could be attached in some other way so as to be immovable relative to the front portion of the helmet.

A dynamically movable face-piece (3) is mounted in the rigid shell (4) which can be of any type such as those already described with reference to Figures 1–3. The face-piece (3) illustrated is the same as that shown in FIG. 2 and includes re-entrant section (20) but this is for illustrative purposes only. Breathable gas is fed to the interior of the face-piece (3) through an inlet hose connected to the gas source and regulator. None of these components are shown in FIG. 5 for ease of illustration.

The helmet and facemask shown in FIG. 5 operate in the same way as has already been described with reference to the embodiments shown in FIGS. 1–4. It will be appreciated however that the rigid shell is fixed relative to the wearer's face due to it being mounted on the front portion (38) of the helmet which itself is a fixed distance relative to the wearer's face. Thus, in use, the face-piece (3) moves relative to the shell (4) while the visor (36) is maintained at a fixed distance relative to the wearer's eyes. The mounting means (37) can incorporate adjustment means (not shown) to move the shell (4) towards or away from the wearer's face to ensure that it makes a proper fit therewith and accommodates differences in the wearer's facial features.

Because the visor (36) never moves relative to the wearer's eyes during pressure breathing, the illustrated helmet is ideal for use with helmet mounted or other avionics systems.

I claim:

1. Breathing apparatus for aircrew comprising a rigid outer shell in which a flexible face-piece is received whose periphery is adapted to make a seal with the pilot's face, the face-piece incorporating an inspiratory and expiratory valve and the outer shell having means for attaching it at a fixed distance from the wearer's face, the face-piece further including extendable means automatically operable to press the periphery of the face-piece towards the pilot's face to improve the seal therewith when gas at a pressure above that required for normal breathing is supplied to the facemask and the extendable means reconfigured as a result thereof, the improvement comprising transparent viewing means disposed in the wearer's line of sight and on the rigid outer shell in a fixed position relative thereto, said viewing means thereby being maintained at a fixed distance relative to the wearer's eyes.

2. Breathing apparatus as claimed in claim 1 wherein the outer shell comprises the front piece of a flexible NBC hood which incorporates a viewing window therein as an integral part thereof.

3. Breathing apparatus as claimed in claim 1 wherein the viewing means comprises a transparent screen mounted on means extending from the rigid shell into the pilot's line of sight.

4. Breathing apparatus as claimed in claim 1 wherein the rigid outer shell comprises the front part of a full-face protective helmet having a visor or window assembly therein which acts as the transparent viewing means.

5. Breathing apparatus as claimed in claim 1 wherein the extendable means is a bladder located between the rigid outer shell and facemask.

6. Breathing apparatus as claimed in claim 1 wherein bellows-like configurations are provided at the periphery of the facemask which are extendable when gas is supplied to the interior thereof.

7. Breathing apparatus as claimed in claim 1 wherein the extendable means comprises an inflatable bladder in combination with reconfigurable means.

* * * * *